United States Patent [19]

Rogers et al.

[11] Patent Number: 4,993,762

[45] Date of Patent: Feb. 19, 1991

[54] LATCH ASSEMBLY AND CONCEALED OPENING

[75] Inventors: Leonard P. Rogers; Will McKay, both of Florence, S.C.

[73] Assignee: RAM Enterprises, Inc., Florence, S.C.

[21] Appl. No.: 429,321

[22] Filed: Oct. 31, 1989

[51] Int. Cl.[5] ..... E05C 19/06

[52] U.S. Cl. ..... 292/303; 292/DIG. 46; 292/81; 70/63

[58] Field of Search ..... 292/303, 81, 84, 80, 292/87; 70/63

[56] References Cited

U.S. PATENT DOCUMENTS

| | | | |
|---|---|---|---|
| 313,857 | 3/1885 | Dunn | 292/80 |
| 346,575 | 8/1886 | Bailey . | |
| 406,173 | 7/1889 | Lipe | 292/80 |
| 1,094,773 | 4/1914 | Behler . | |
| 1,636,697 | 7/1927 | Larson et al. | 292/17 |
| 2,029,913 | 2/1936 | Crumring | 292/80 X |
| 3,720,013 | 3/1973 | McDonald . | |
| 4,119,199 | 10/1978 | Whitaker, Jr. . | |
| 4,768,021 | 8/1988 | Ferraro | 70/63 X |

*Primary Examiner*—Richard E. Moore

*Attorney, Agent, or Firm*—Bailey & Hardaway

[57] ABSTRACT

A container having a concealed closure which is operable through a mechanism on the interior of the container only by deformation of a resiliently deformable top closure.

5 Claims, 2 Drawing Sheets

LATCH ASSEMBLY AND CONCEALED OPENING

BACKGROUND OF THE INVENTION

This invention related generally to the art of containers and more particularly to a container with concealed locking means.

A variety of containers have been developed in the prior art which have as the primary purpose the concealing of various items such as guns, jewelry, etc. For example, U.S. Pat. No. 3,720,013 discloses a handgun concealing pouch while U.S. Pat. No. 4,119,199 discloses a safety weapon receptacle which has a concealed locking mechanism.

U.S. Pat. Nos. 1,094,773 and 346,575 disclose diverse latching mechanisms.

While a variety of such devices have existed in the prior art there has been no device which lends itself to attractive display while simultaneously having a well disguised means for opening.

SUMMARY OF THE INVENTION

It is thus an object of this invention to provide a novel locking container.

It is a further object of this invention to provide a novel locking container which has the opening mechanism thereof well disguised from obvious operation.

These as well as other objects are accomplished by a locking container which appears to have a standard opening means but instead is formed by three generally upright walls forming a portion of a parallelogram with a fourth side thereof being slidably engaged in the other three walls. A top closure slides through the fourth wall into slots in the other three walls and carries on the bottom thereof a spring latch which engages an angular catch on the wall opposite the fourth wall. The wall opposite the fourth wall carries an angular catch for engaging the spring latch which is released by depressing the top closure which is resiliently deformable.

DETAILED DESCRIPTION

In accordance with this invention, it has been found that a container may be provided which appears to have normal opening means but which instead has disguised opening means totally disguised by the outside appearance of the container. Various other advantages and features will become apparent from a reading of the following description given with reference to the various figures of drawings.

Figure 1:
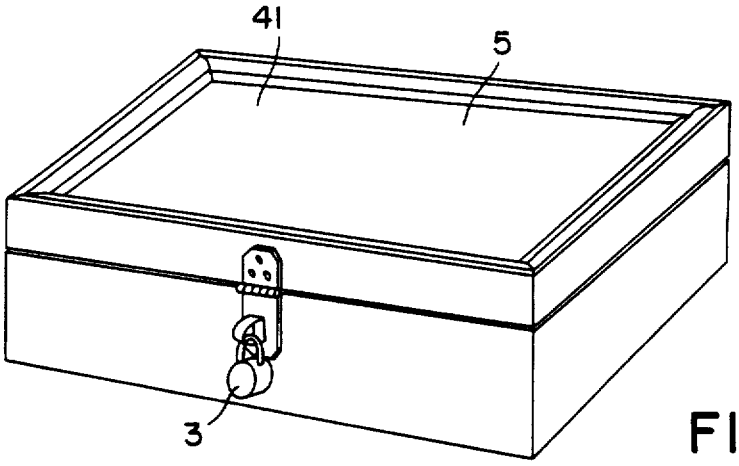
FIG. 1 of the drawings illustrates the container in accordance with this invention in the closed state in a perspective view.

FIG. 1 of the drawings illustrates a container 1 in accordance with this invention. The container 1 appears to be a normal fliptop opening type of container having a standard lock 3 thereon. The container 1 in actuality has a top closure 5 which is illustrated in the open position in FIG. 2. The top closure 5 is locked in the closed position as illustrated in FIG. 1 when a latch to be further described below contacts a catch 7 within the contents of the container.

It is seen that the container is formed by a series of upstanding walls 10, 12 and 14 which is illustrated here in the form of a rectangular but which may be in the form of any parallelogram such that a sliding top closure such as 5 may be removed through slots in adjoining walls. As illustrated here the three walls 10, 12 and 14 have slots 9, 11 and 13 therein. The fourth wall 15 has no slot therein but is terminated below the remaining slots to permit the top closure 5 to slide therethrough.

Figure 3:
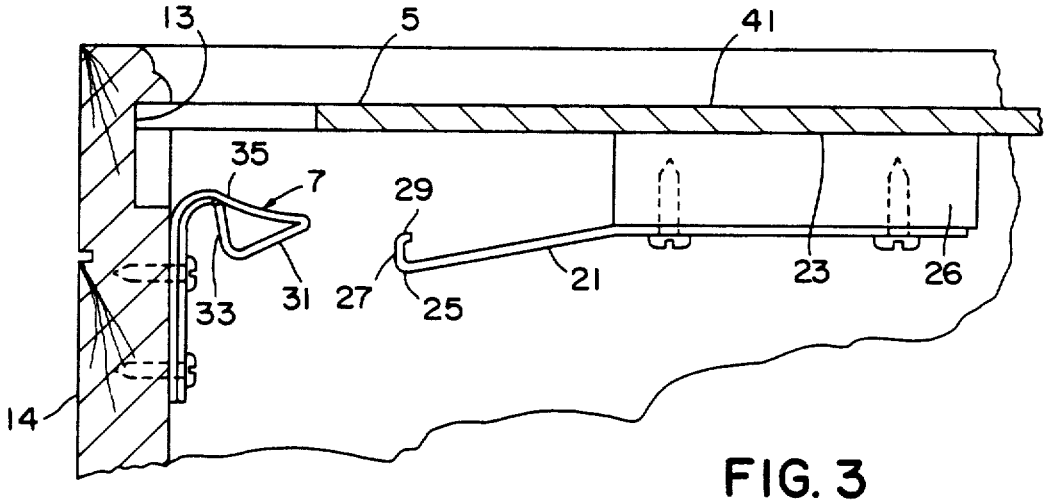
FIG. 3 of the drawings is a cross-section of an enlarged portion of FIG. 2 showing the latching mechanism of this invention.

FIG. 3 of the drawings is an enlarged view of a cross-section of inside of the container adjacent wall 14 showing catch 7 thereon and a latch spring 21 carried beneath the innersurface 23 of top closure 5. Latch spring 21 is inclined toward wall 14 which is indeed the wall opposite the fourth wall 15. The latch spring 21 curves upwardly at 25 to form a vertical section 27 and terminates in a reverse bend to form a sliding surface 29 catch 7 has an downwardly inclined surface 31 for engaging sliding surface 29 and an upwardly inclined surface 33 for locking with the sliding surface 29 and vertical section 27. Both the downwardly inclined surface 31 and upwardly inclined surface 33 are carried by an uppersurface 35 of the catch 7.

The top closure 5 is resiliently deformable and may be formed of an appropriate material such as laminated wood. When the top closure is in the locked position as illustrated in FIG. 1, thumb pressure may be applied above the spring latch as at 41 to remove the vertical section 27 from a mating relationship with the upperwardly inclined surface 33 to permit simultaneous reverse sliding of top closure 5 while the top closure is resiliently depressed. It is thus seen that this mechanism for opening is totally obscured by the exterior construction of the container and would be known only to those who had been appropriately informed of the opening mechanism thereof.

Figure 2:
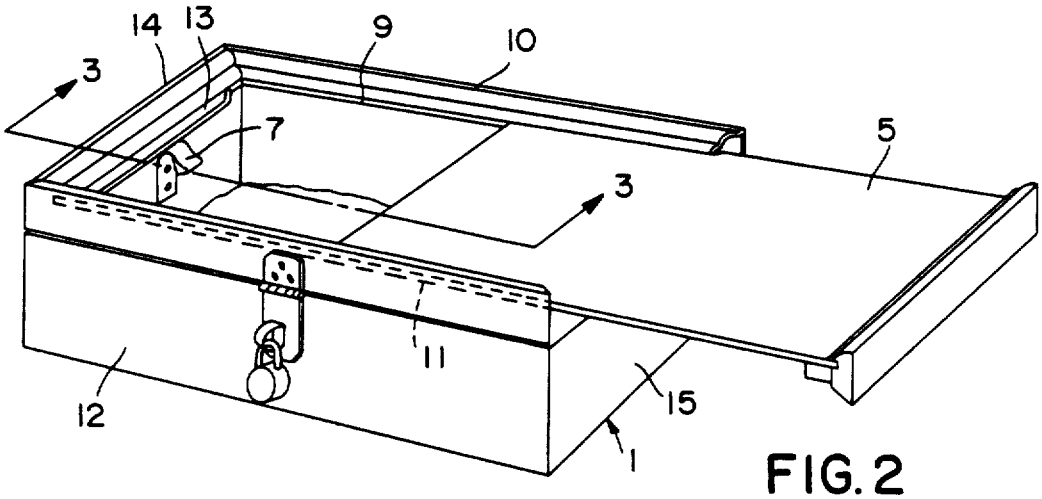
FIG. 2 of the drawings illustrates the container of this invention in the open position.
Figure 4:
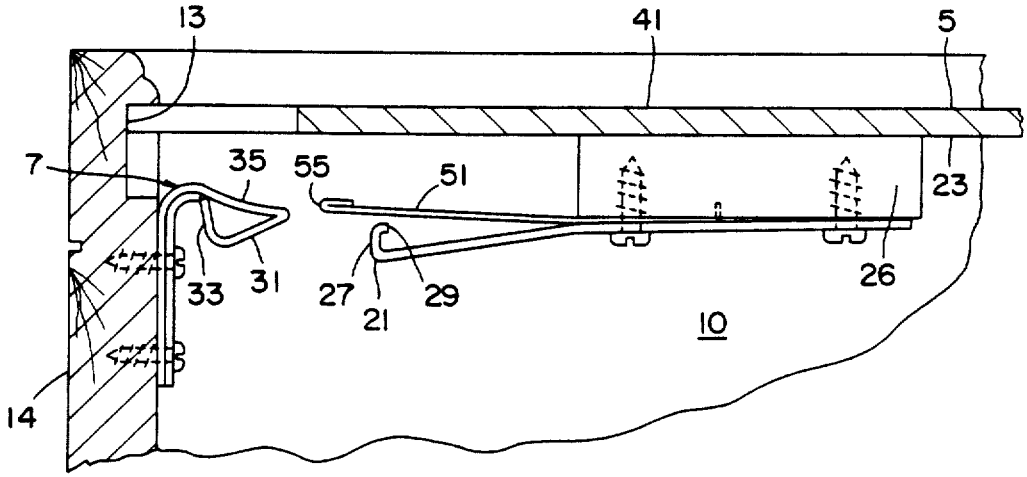
FIG. 4 of the drawings illustrates a cross-section view of a preferred embodiment of a latching mechanism in accordance with this invention.
Figure 5:
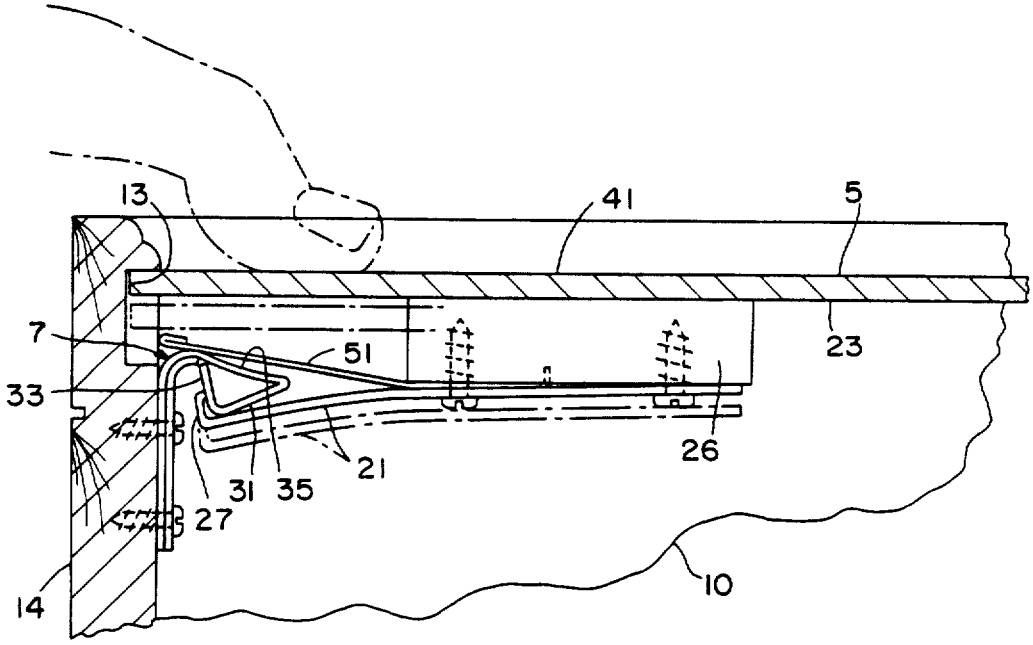
FIG. 5 is a view similar to FIG. 4 showing the latching mechanism in the closed position.

FIG. 4 of the drawings illustrates a preferred embodiment of this invention which is similar to the embodiments illustrated in FIG. 1 through 3 and has the same components thereof with the exception of an additional spring guide 51 which is above spring latch 21 and below the innersurface 23 of top closure 5. Spring guide 51 has an engaging surface 55 for engaging uppersurface 35 of catch 7. By this placement of spring guide 51 the top closure 5 is stabilized by the upward flexing of engaging surface 55 as transmitted to deformable top 5 via attachment block 26. This embodiment has a greater stability and precise engagement of the top closure 5 into slot seat 13. This embodiment is also opened by thumb depression of deformable top 5 at 41.

It is thus seen that the invention as described provides a novel container with a disguised means for opening. As the above description is exemplary in nature many variations thereof will become apparent to those of skill in the art. Such variations, however, are embodied within the spirit and scope of the following appended claims:

THAT WHICH IS CLAIMED IS:

1. A locking container comprising:

three generally upright walls forming a portion of a parallelogram each said wall having an innersurface and an outersurface;

each innersurface having a slot therein with each slot contiguous with a slot of an adjoining wall;

a fourth generally upright wall closing said parallelogram and terminating below said slots;

a top closure slidably received within said slots of said three upright walls, said top closure having an outer uppersurface and a lower innersurface;

a spring latch on said lower innersurface of said top closure said spring latch extending toward the upright wall opposite said fourth wall with a downward incline, said spring latch terminating in a vertical section having a reverse bend therein to form a sliding surface;

an angular catch on said wall opposite said fourth wall having a downwardly inclined surface for receipt of said sliding surface and a bend therein to form an upwardly inclined surface inclined upwardly toward said wall opposite said fourth wall;

whereby upon sliding said top closure through said slots towards said wall opposite said fourth wall said sliding surface of said spring latch engages said downwardly inclined surface of said angular catch and slides therein until intersecting said upwardly inclined surface where said vertical section of said spring latch mates with said downwardly inclined surface and upwardly inclined surface to retain said top closure against further movement.

2. The container according to claim 1 wherein said top closure is resiliently deformable whereby upon depression of said resiliently deformable top closure, said vertical section of said spring latch disengages from mating with said upwardly inclined surface and said downwardly inclined surface to permit said top closure to be moved in said slots away from said wall opposite said fourth wall.

3. The closure according to claim 1 wherein said catch has an upper surface over said downwardly inclined surface and said upwardly inclined surface for receiving said engaging surface of said spring guide and stabilizing said top closure through an attachment block mounted on the top closure.

4. The container according to claim 1 wherein said catch has an uppersurface above said downwardly inclined surface and said upperwardly inclined surface and further comprising:

a spring guide above said latch but below said innersurface of said top closure, said spring guide contacting said uppersurface of said catch to stabilize and guide said top closure into said slot of said wall opposite said fourth wall.

5. The container according to claim 4 wherein said top closure is resiliently deformable whereby upon depression of said resiliently deformable top closure said vertical section of said spring latch disengages from mating with said upwardly inclined surface and said downwardly inclined surface to permit said top closure to be moved in said slots away from said wall opposite said fourth wall.

* * * * *